US009938053B2

(12) United States Patent
Wintrich et al.

(10) Patent No.: US 9,938,053 B2
(45) Date of Patent: Apr. 10, 2018

(54) CONTAINER HAVING A CLOSABLE LOADING OPENING

(71) Applicant: KTP Kunststoff Palettentechnik GmbH, Bous (DE)

(72) Inventors: Andreas Wintrich, Wadern-Nunkirchen (DE); Alexander Getting, Dillingen (DE)

(73) Assignee: KTP KUNSTSTOFF PALETTENTECHNIK GMBH, Bous (DE)

( * ) Notice: Subject to any disclaimer, the term of this patent is extended or adjusted under 35 U.S.C. 154(b) by 281 days.

(21) Appl. No.: 14/598,980

(22) Filed: Jan. 16, 2015

(65) Prior Publication Data

US 2015/0203255 A1 Jul. 23, 2015

(30) Foreign Application Priority Data

Jan. 23, 2014 (DJ) ..... 10 2014 100 742
Jun. 25, 2014 (DE) ..... 10 2014 108 853

(51) Int. Cl.
*B65D 6/40* (2006.01)
*B65D 43/22* (2006.01)
(Continued)

(52) U.S. Cl.
CPC ..... *B65D 43/22* (2013.01); *B65D 19/02* (2013.01); *B65D 19/18* (2013.01); *B65D 25/005* (2013.01); *B65D 43/16* (2013.01); *B65D 2519/00034* (2013.01); *B65D 2519/00069* (2013.01); *B65D 2519/00174* (2013.01);
(Continued)

(58) Field of Classification Search
CPC ..... B65D 45/00; B65D 45/02; B65D 45/16; B65D 45/20; B65D 45/22; B65D 19/02; B65D 19/06; B65D 19/18; B65D 25/005
See application file for complete search history.

(56) References Cited

U.S. PATENT DOCUMENTS 4,917,255 A * 4/1990 Foy ..... B65D 25/005 206/503
5,161,709 A * 11/1992 Oestreich, Jr. ..... B65D 19/12 220/1.5
(Continued)

FOREIGN PATENT DOCUMENTS

DE 9217845 U1 2/1993
DE 9217849 U1 2/1993
(Continued)

*Primary Examiner* — Steven A. Reynolds
*Assistant Examiner* — Javier A Pagan

(57) ABSTRACT

A container, in particular a pallet container, having at least one side wall, a loading opening that can be closed by a flap, and a device for holding the flap in a closed position. The holding device includes a retainer, which is arranged on the side wall or on the flap and which is intended to hold the flap in the closed position and is designed so that the flap is movable to the closed position when a counterforce exerted by the retainer is overcome. The holding device holds the flap in the closed position by latching the flap on the retainer, by latching the retainer on the side wall, or by latching the retainer on a holding member that is provided to receive the retainer and is arranged on the flap or on the side wall.

20 Claims, 6 Drawing Sheets

(51) Int. Cl.

| | |
|---|---|
| ***B65D 19/02*** | (2006.01) |
| ***B65D 43/16*** | (2006.01) |
| ***B65D 19/18*** | (2006.01) |
| ***B65D 25/00*** | (2006.01) |

(52) U.S. Cl.
CPC ..... *B65D 2519/00208* (2013.01); *B65D 2519/00338* (2013.01); *B65D 2519/00597* (2013.01); *B65D 2519/00641* (2013.01); *B65D 2519/00711* (2013.01); *B65D 2519/00805* (2013.01); *B65D 2519/00915* (2013.01); *B65D 2519/00975* (2013.01)

(56) References Cited

U.S. PATENT DOCUMENTS 6,772,897 B2 * 8/2004 Kellerer ..... B65D 11/1833 220/6
8,276,299 B2 * 10/2012 Schutz ..... B65D 25/205 40/308
8,579,147 B2 * 11/2013 Dubois ..... B65D 11/1833 220/666

FOREIGN PATENT DOCUMENTS

| | | | | |
|---|---|---|---|---|
| DE | 9410243 | U1 | 9/1994 | |
| DE | 19545282 | A1 | 6/1996 | |
| DE | 202005009037 | U1 | 8/2006 | |
| DE | 10041886 | B4 | 3/2007 | |
| DE | 102008045758 | A1 | 3/2010 | |
| DE | 202010004170 | U1 | 8/2011 | |
| EP | 0385914 | B1 | 6/1993 | |
| EP | 1182139 | A2 | 2/2002 | |
| EP | 1437306 | A1 | 7/2004 | |
| FR | 2686061 | A1 | 7/1993 | |
| FR | 2686118 | A1 * | 7/1993 | ..... E05C 1/10 |
| GB | 2296008 | A | 6/1996 | |
| JP | H0633086 | B2 | 5/1994 | |
| WO | 2009153693 | A1 | 12/2009 | |
| WO | 2012115561 | A1 | 8/2012 | |

* cited by examiner (a)

(b)

(c)

(c)

CONTAINER HAVING A CLOSABLE LOADING OPENING

CROSS-REFERENCE TO RELATED APPLICATIONS

The present application claims priority of DE 10 2014 100 742.5, filed Jan. 23, 2014, and DE 10 2014 108 853.0, filed Jun. 25, 2014, the priority of these applications is hereby claimed and these applications are incorporated herein by reference.

BACKGROUND OF THE INVENTION

The invention relates to a container, in particular a pallet container, which has, on at least one side wall, a loading opening that can be closed by a flap, and which comprises a device for holding the flap in a closed position.

Such a container is known from DE 20 2010 004 170 U1. To lock the flap, said container is provided with bolts that can be slid across an edge of the loading opening.

A further container of the abovementioned type, provided with bolts, is known from DE 20 2005 009 037 U1.

SUMMARY OF THE INVENTION

The object of the invention is to further develop the container in such a way that the holding device is easier to handle.

According to the invention, this object is achieved by the fact that the holding device comprises a retainer, which is arranged on the side wall or on the flap and which is intended to hold the flap in the closed position and is designed in such a way that the flap is movable to the closed position when a counterforce exerted by the retainer is overcome.

The flap of the container according to the invention can be pressed into the closed position with a single maneuver. The handling of the flap is thus simplified significantly by comparison with the known devices in which several maneuvers are needed to lock the flap in the closed position.

In the case where the retainer is arranged on an edge of the side wall directed toward the loading opening, the flap, with its side edge directed toward the retainer, is pressed past the retainer, against the counterforce exerted by the retainer, with the side edge sliding along the retainer. Seen in the closure direction, the flap latches behind the retainer in the closed position and is held in the closed position by the retainer.

In the case where the retainer is arranged on the flap, the retainer, together with the flap, is pushed past the edge of the side wall directed toward the loading opening, with the retainer sliding along the edge. Seen in the closure direction, the retainer latches behind the side wall in the closed position and in this way holds the flap in the closed position.

While it would be conceivable to provide a separate mechanism by means of which the retainer can be moved to an open position in which the flap can be moved past the retainer from the closed position, the flap in the preferred embodiment of the invention is likewise movable from the closed position to the open position when the counterforce is overcome.

The container expediently has a base, and interconnected side walls that are collapsible, the side walls preferably being connected on the vertical container edges so as to be able to arrange them on the base in the collapsed state. Moreover, the container expediently has a cover that can be mounted on the side walls.

While it would be conceivable to arrange the side walls in an octagonal or other foldable form, the container, in a preferred embodiment of the invention, is cuboidal in the set-up state, and the side walls adjacent to the side wall provided with the loading opening are each provided at their center with a folding line which is parallel to the vertical container edges. When the side walls are folded together, the side wall parts that are separated by the folding line bear one against the other and between the two other side walls.

In a preferred embodiment of the invention, the loading opening is formed on an upper edge of the side wall, on which edge the optionally provided cover can be mounted. The retainer is expediently provided on both opposite flap edges directed toward the side wall and/or on both opposite edges of the side wall that are directed toward the flap. The flap can be brought to the closed position and from the closed position by each of the holding devices being actuated, if appropriate simultaneously, with one hand each.

In the case where the retainer is arranged on the side wall, the retainer, for simple operation by hand, is expediently provided on said edge or at least near this edge of the side wall on which the loading opening is formed.

If the retainer is provided on the flap, it is preferably formed on the edge of the flap directed away from a hinge that connects the flap to the side wall, i.e., preferably on an upper edge of the flap, on which upper edge the cover may optionally be mounted.

The flap can advantageously be latched on the retainer in the closed position by placing the hand on the side wall in such a way that the fingers grip next to the loading opening over the upper edge of the side wall and the thumb presses the flap into the closed position. Particularly in containers comprising the cover that can be mounted on the side wall, the retainer is expediently provided at a certain distance from said edges. However, it has proven advantageous to arrange the retainer at a distance from the upper edge not greater than one fifth, preferably not greater than one tenth, of the height of the loading opening. For maneuvering the holding device by hand, the distance from the upper edge is preferably not more than 10 cm.

In one embodiment of the invention, the retainer comprises a holding body protruding from the flap in the direction of the side wall or a holding body protruding from the side wall in the direction of the flap, across a slit between the flap and the side wall. The holding body preferably has a convex curvature, at least in an area where the flap is pushed past it or where it is pushed past the side wall, such that the flap can be brought to the closed position as smoothly as possible.

To permit a movement of the flap to and from the closed position past the holding body into the closed position, the container is expediently provided in such a way that the retainer, the flap and/or the side wall elastically deform when the counterforce exerted by the holding body is overcome.

In one embodiment of the invention, a cutting is formed on the side wall or the flap, in which cutting the holding body engages in the closed position. The cutting, which forms a seat for the holding body in the closed position, ensures that the flap is held in the closed position by the holding device.

Moreover, the holding body can be provided in such a way that it engages completely behind the edge of the flap or of the side wall in the closed position, i.e. is arranged on the outer face or on the inner face of the container.

While it would be conceivable to connect the flap to the side wall in an articulated manner via a separate hinge, for example a barrel hinge, the hinge in the preferred embodiment is formed by a portion of the container wall that can be tilted about an articulated fold.

If the hinge or the fold is formed in such a way that the flap can only be folded outward and the hinge blocks a movement of the flap into the interior of the container, it is sufficient to design the retainer in such a way that the counterforce for a movement from the closed position is formed only in the outward folding direction.

If the flap is connected to the side wall in such a way that it can be folded both into the interior of the container and also outwardly, e.g. via said barrel hinge, the retainer can be formed in such a way that it exerts a counterforce both during movement of the flap into the interior and also during outward movement. The holding body is then expediently provided both on the outer face and also on the inner face.

Moreover, the holding device can comprise an abutment element, which prevents a movement of the flap in the respective flap direction that is to be blocked, preferably in the flap direction toward the interior of the container.

In one embodiment of the invention, the abutment element protrudes from the flap via a side edge of the flap lying opposite an edge of the side wall directed toward the loading opening. In this case, the holding device is expediently secured on the flap, preferably on the outer face of the flap. The abutment element preferably protrudes, on the outer face of the flap, across said side edge.

Alternatively or in addition to this, the abutment element can also be arranged on the container in such a way that, on the inner face of the side wall, it protrudes across an edge of the side wall directed toward the loading opening, lying opposite an edge of the flap. The holding device is then expediently secured on the side wall, preferably on the inner face of the side wall. The abutment element then preferably protrudes, on the inner face, from said edge of the flap.

In one embodiment of the invention, the retainer and the abutment element are together secured on the side wall or on the flap. They are preferably formed in one piece.

While provision is made, according to one embodiment of the invention, that the side wall or the flap is moved directly past the retainer when the flap is moved to or from the closed position, the holding device, in a further embodiment of the invention, comprises a holding member provided for receiving the retainer, which holding member, depending on the arrangement of the retainer on the side wall or the flap, is arranged opposite on the flap or on the side wall.

The holding member expediently has a recess into which the holding body latches in the closed position. To cooperate with the holding member, the holding body preferably protrudes from the flap in a direction in which the flap is to be closed, or protrudes from the side wall in a direction in which the flap is to be opened. For this purpose, the holding body expediently has an angled shape, preferably at 90°, and is arranged on the flap or the side wall in such a way that an end portion of the angled shape protrudes in the flap closure direction or the flap opening direction. If the holding member likewise has a corresponding angled shape, and if it is arranged in the opposite direction to the holding body, then the holding body and the holding member can engage in each other in the closed position.

In a further embodiment of the invention, the holding body has, on its edge directed toward the holding member, a thickening which is arranged in said recess in the closed position. Seen in the flap closure direction, the holding member expediently has, seen in cross section in front of the recess, a channel which is narrower than the holding member in the area of the thickening and through which the thickening of the holding body is movable to the closed position with elastic deformation of the holding body and/or of the holding member.

In a particularly preferred embodiment of the invention, both the holding body and also the holding member have a hook-like shape and are arranged lying opposite each other in such a way that hook elements of the holding body and of the holding member engage in each other in the closed position and hook the holding body on the holding member. A cutting is expediently provided in the holding body and the holding member, into which cutting the respective hook elements can be moved with elastic deformation when the flap is moved to or from the closed position. In the areas in which they are moved toward each other, hook portions of the hook elements preferably have roundings in order to facilitate a movement of the hook portions toward each other.

The retainer, the holding body, the holding member and/or the abutment element can be designed as strips which are provided only in part, or over the entire height of the loading opening, on the edge of the side wall or of the flap. However, in the preferred embodiment of the invention, the retainer, the holding body and/or the holding member are formed only on a relatively short portion, which amounts to at most a tenth of the height of the loading opening.

The length of the retainer, of the holding body or of the holding member relative to the height of the loading opening is expediently not more than 10 cm, preferably not more than 5 cm.

In one embodiment of the invention, depending on the intended arrangement on the flap or on the side wall, the retainer, the holding body, the holding member and/or the abutment element are formed in one piece with the flap or the side wall. Advantageously, the holding device can already be provided during the production of the container, which is preferably made of plastic.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
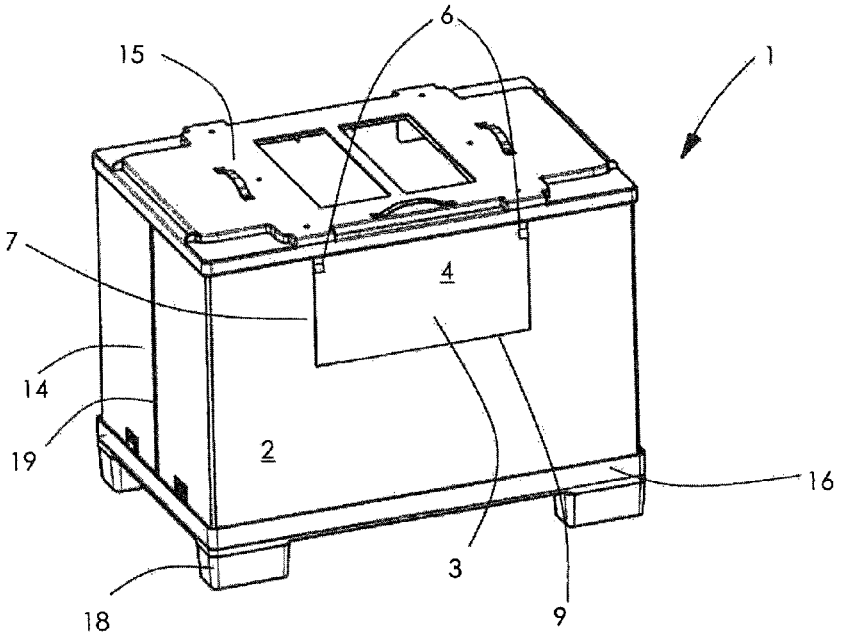
FIG. 1 shows a perspective view of a container according to the invention.
Figure 2:
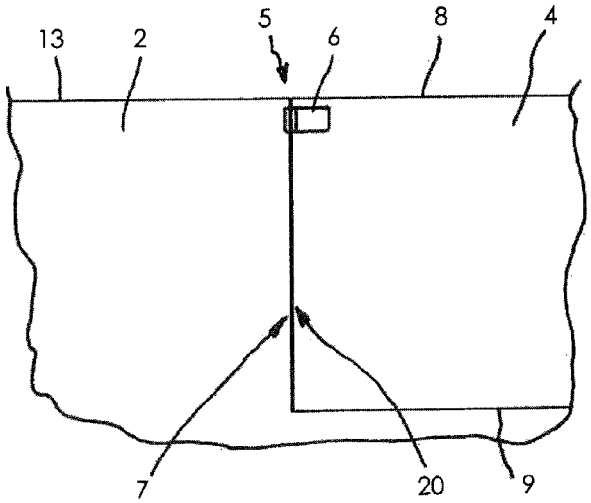
FIG. 2 shows a detail of the container according to FIG. 1 in a side view.

A container 1 shown in FIG. 1 has a base 16, side walls 2, 14, and a cover 15. The base 16 consists of a molded plastics part and has, at its four corners, feet 18, which are formed as deepenings of the base 16 and between which there is space for engagement of a lifting fork of a fork-lift truck.

The side walls 2, 14 consist of a plastics material structured with a form resembling corrugated board and are welded at their vertical edges in such a way that they can be folded there. Furthermore, the shorter side walls 14 are provided at their center with a fold line running parallel to the edges and similarly welded. The cover 15 can be lifted completely from the side walls 2, 14, and the side walls 2, 14 can be removed from the base 16, folded together and laid on the base, and enclosed between the base 16 and the cover 15. As is known from DE 295 01 254 U1, the container can then be stored with minimum space requirements when it is not loaded. The base 16, the side walls 2, 14 and/or the cover 15 can also be interconnected by hinges, as is described in the German patent applications no. 10 2009 024 081.0 and no. 10 2009 024 043.8.

A loading opening 3, which is closed by a flap 4, is provided in the side wall 2 of the container 1. The flap 4 is formed by a wall portion which can be folded out and which is connected to the side wall 2 by an articulated fold 9 that is provided on a lower side of the loading opening 1 and that forms a hinge. As is shown more clearly in the subsequent figures, a holding element 6 is arranged on each of the two side edges 20 of the flap 4.

Figure 3:
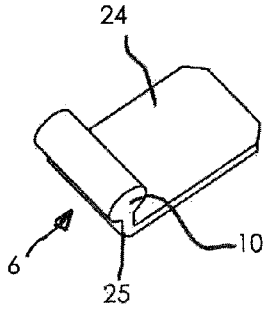
FIG. 3 shows a perspective view of a component part of the container according to FIG. 1.

The holding element 6 comprises a securing portion 24, which is shown in FIG. 3 and with which the holding element 6 is secured on the flap 4 by means of a rivet 25 or the like, and a retainer 10 which protrudes from the securing portion 24 and has a substantially round outer contour.

Figure 4:
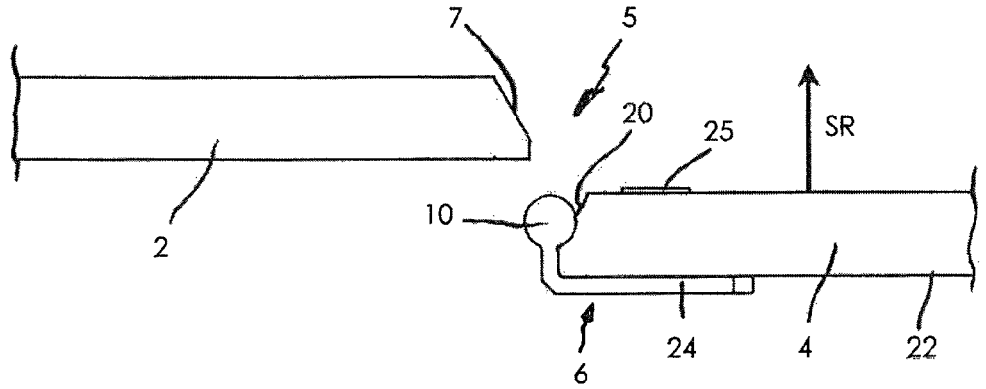
FIG. 4 shows a detail of the container according to FIG. 1, seen from above in cross section and in various positions.
Figure 4:
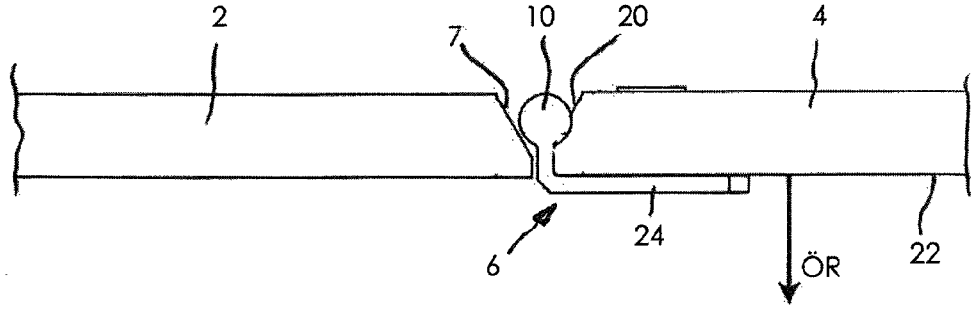
Figure 4:
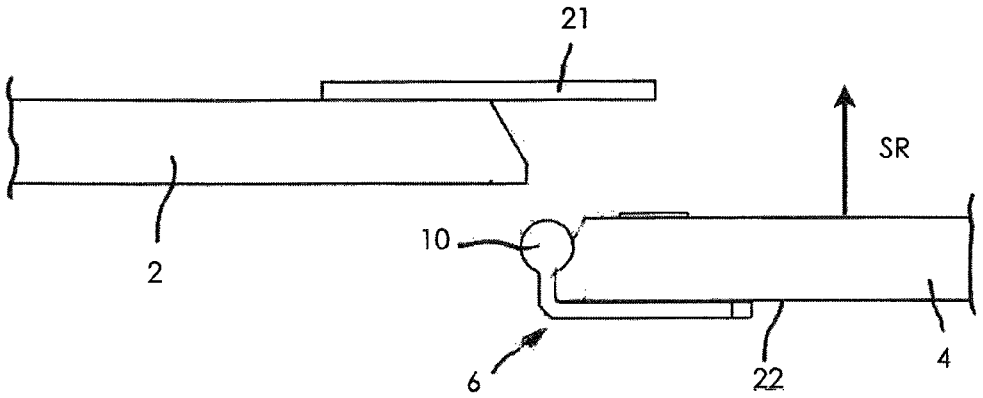

As FIG. 4 shows, the holding element 6 is secured with its securing portion 24 on an outer face 22 of the flap 4. On the side edge 20 of the flap 4, a cutting (not shown here) is formed for receiving the holding element 6, which cutting is provided in such a way that an outer edge portion 25 of the securing portion 24 ends flush with the side edge 20. As FIG. 4 further shows, the side edge 20 of the flap 4 and a loading-opening edge 7 directed toward the flap 4 are beveled in order to receive the retainer 10.

In order to close the loading opening 3 with the flap 4, the latter is first of all brought to the position shown in FIG. 4*a*, in which the retainer 10 bears on the inner face of the side edge 7 of the side wall 2. In order to move the flap 4 by hand from this position in the closure direction shown by the arrow SR, the fingers are placed over the upper edge 13 of the side wall 2 and the thumb presses against the holding element 6, such that the retainer 10 is pressed past the loading-opening edge 7. In doing this, the side wall 2 and the flap 4 bend elastically to a slight extent. The retainer 10 then latches on the edge 7 of the side wall 2 in a closed position of the flap 4.

In order to move the flap 4 from the closed position again, the retainer 10 is pressed by hand past the edge 7 in the opening direction shown by the arrow ÖR, with the side wall 2 and the flap 4 elastically deforming again.

Whereas the holding device 5 shown in FIGS. 4*a* and *b* is suitable in particular for a hinged connection of the flap 4 to the side wall 2, in which the flap 4 can only be folded outward, the illustrative embodiment according to FIG. 4*c* has an abutment piece 21 which is arranged on the inner face of the side wall 2 and which protrudes from the side wall 2 across the loading opening 3, thus ensuring that the flap 4 cannot fold inward into the interior of the container. Mechanical overloading of the fold 9 is avoided in this way.

Figure 5:
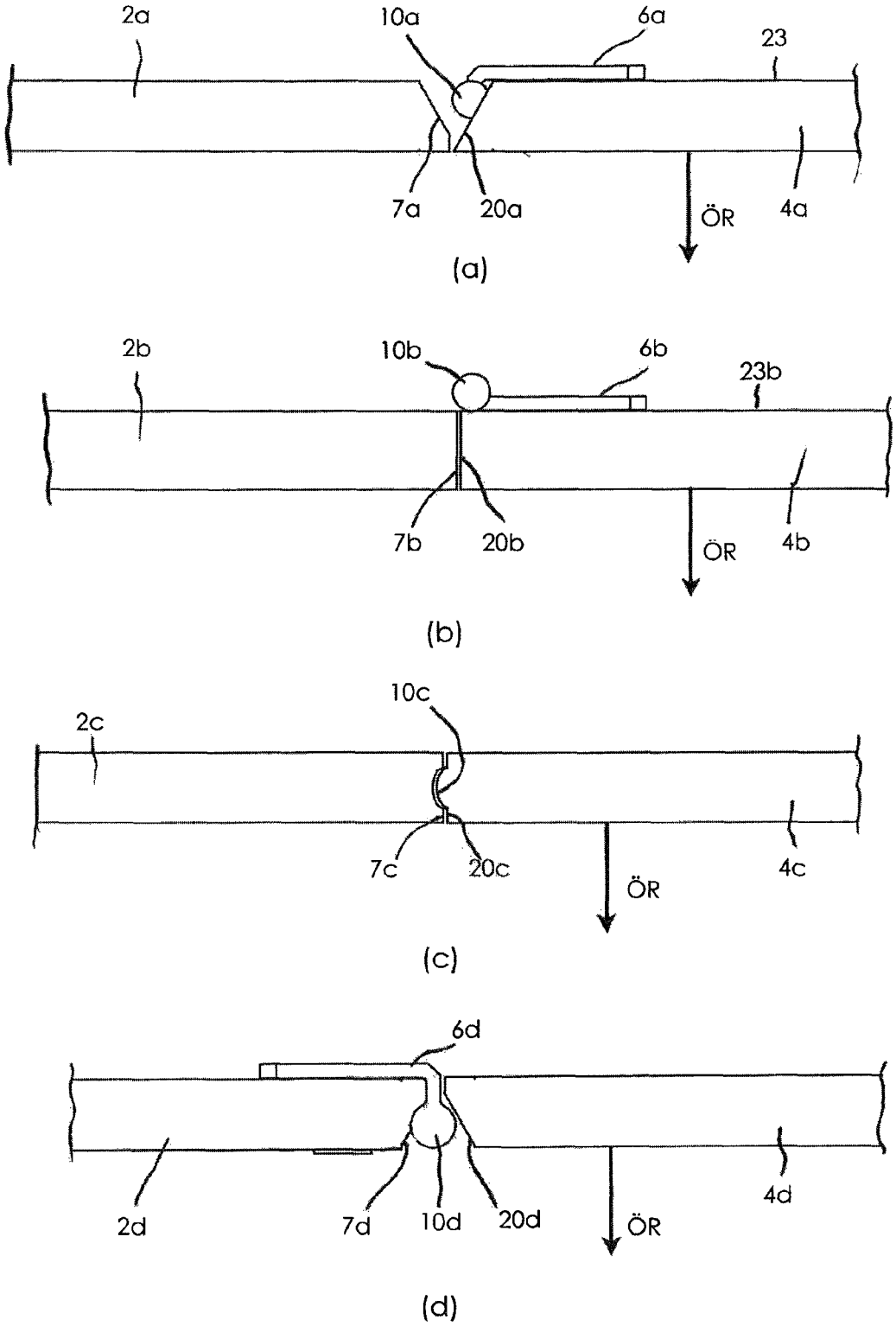
FIG. 5 shows details of various containers according to the invention from above and in cross section.
Figure 6:
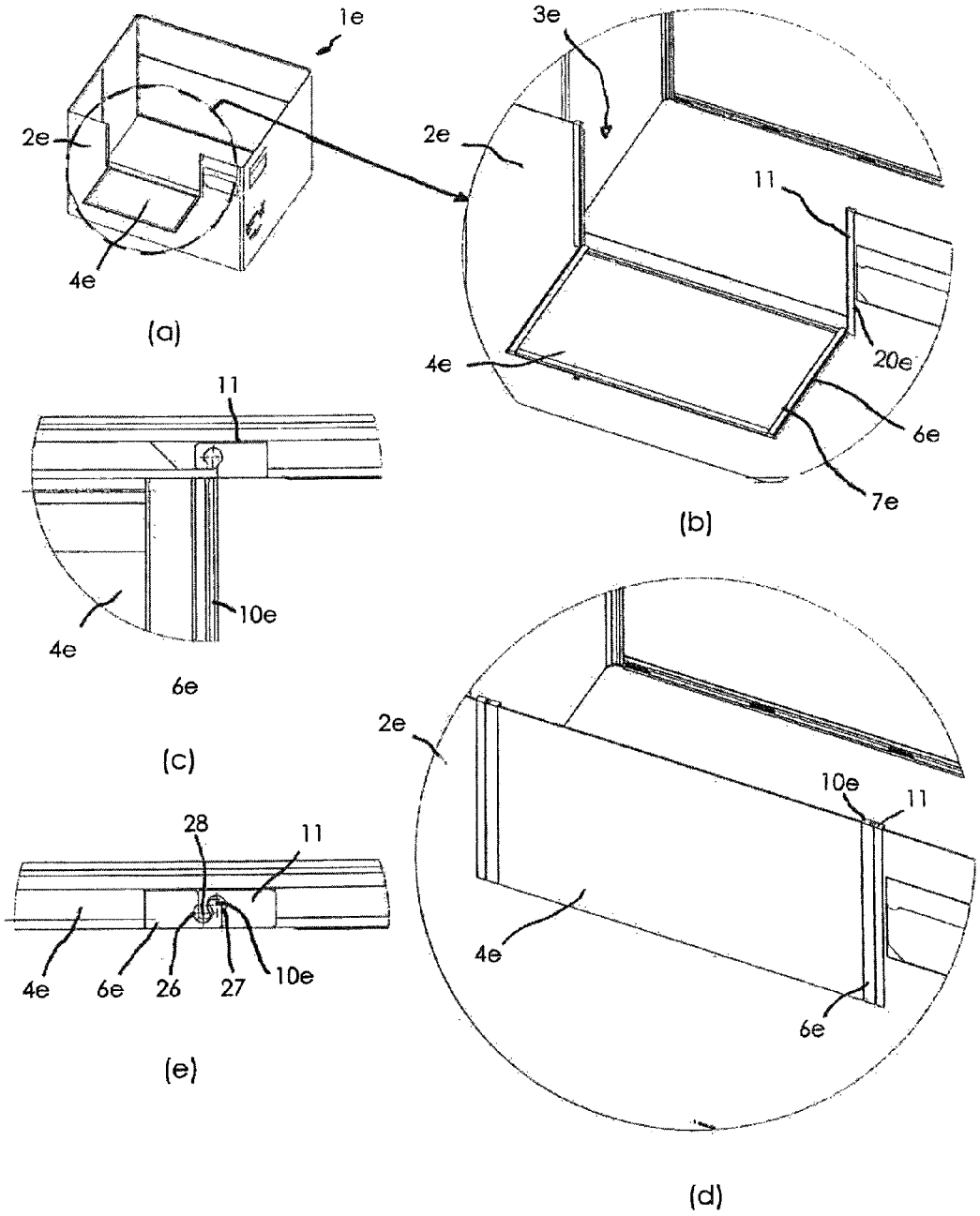
FIG. 6 shows a further container according to the invention, and details thereof in various views.
Figure 7:
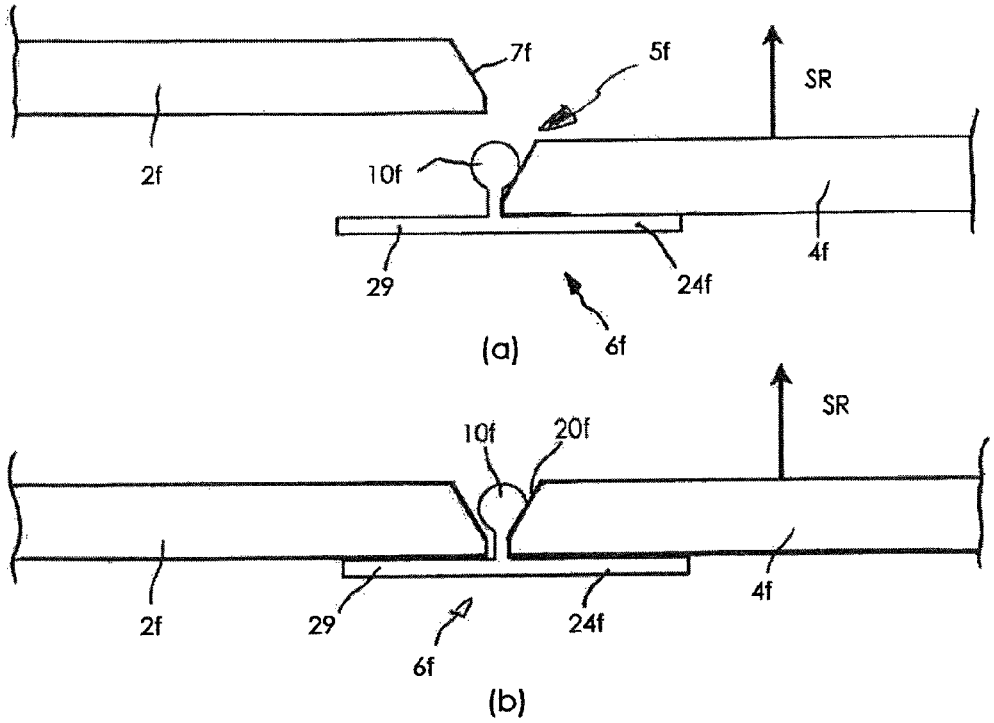
FIG. 7 shows details of a further container according to the invention.
Figure 7:
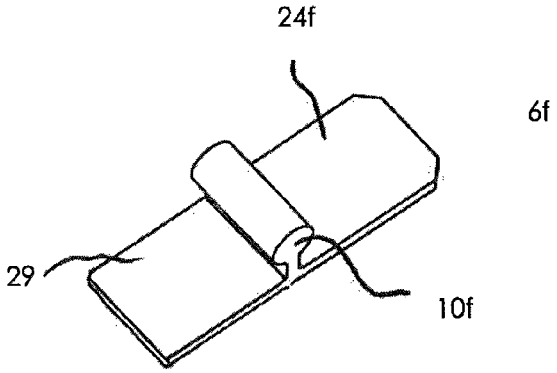

Reference is now made to FIGS. 5 to 7, where identical parts or parts with an identical action are designated by the same reference number as in FIGS. 1 to 4, with a letter added in each case to the reference number in question.

A further holding device 5*f* shown in FIGS. 7*a* and *b* has a holding element 6*f*, which is shown in detail in FIG. 7*c* and which is arranged with a securing portion 24*f* on an outer face of a flap 4*f*. An abutment element 29, formed on the holding element 6*f*, protrudes as a rectilinear continuation of the securing portion 24*f* across an edge 7*f* of the side wall 2*f* directed toward the loading opening, and it thus ensures that the flap 4*f* cannot fold inward into the interior of the container. As is shown in particular in FIG. 7*b*, a retainer 10*f* protruding from the securing portion 24*e* engages behind the edge 7*f* of the side wall 2*f* in the closed position of the flap 4*f* and thus holds the flap 4*f* in the closed position, with the abutment element 29 bearing on the outer face of the side wall 2*f*.

A further holding device shown in FIG. 5*a* differs from those according to FIGS. 4*a* and *b* in that a holding element 6*a* is arranged on an inner face 23 of a flap 4*a*. Advantageously, the holding element 6*a* is then not visible from the outside and is protected from mechanical loads acting on the container from the outside.

In a further embodiment, not shown here, the holding element 6*a* is formed both on the inner face 23 and also on the outer face of the container. In a holding device of this kind, which is particularly suitable for containers in which the hinged connection between the flap 4*a* and the side wall 2*a* allows the flap 4 to fold both inward and also outward, the holding elements 6*a* hold the flap 4*a* in both directions, and the flap 4*a* can be moved from the closed position in both directions, as is described above.

FIG. 5*b* shows a holding element 6*b*, which is likewise arranged on an inner face 23*b* of a flap 4*b* of a container and which is suitable in particular for containers in which a loading-opening edge 7*b* and inside edge 20*b* of a flap 4*b* have a rectangular shape in cross section. Although a retainer 10*b* protrudes across the edge 20*b* of the flap 4*b*, it does not protrude into the area between the side wall 2*b* and the flap 4*b*, and instead, when seen in the closure direction, is arranged behind the flap 1*b* and the side wall 2*b*.

FIG. 5*c* shows a further illustrative embodiment, in which a protuberance is formed on a side edge 20*c* of a flap 4*c* and forms a retainer 10*c*. For the retainer 10*c*, a cutting is provided on an edge 7*c* of the side wall 2*c*, into which cutting the retainer 10*c* latches in the closed position.

In a further illustrative embodiment, shown in FIG. 5*d*, holding element 6*d* is secured on a side wall 2*d*. A flap 4*d* can be brought to a closed position and from a closed position in a similar way to that described with reference to FIGS. 4*a* and *b*, the difference from the previous embodiment being that an edge 20*d* of the flap 4*d* is pushed past a retainer 10*d* of the holding element 6*d*.

Figure 8:
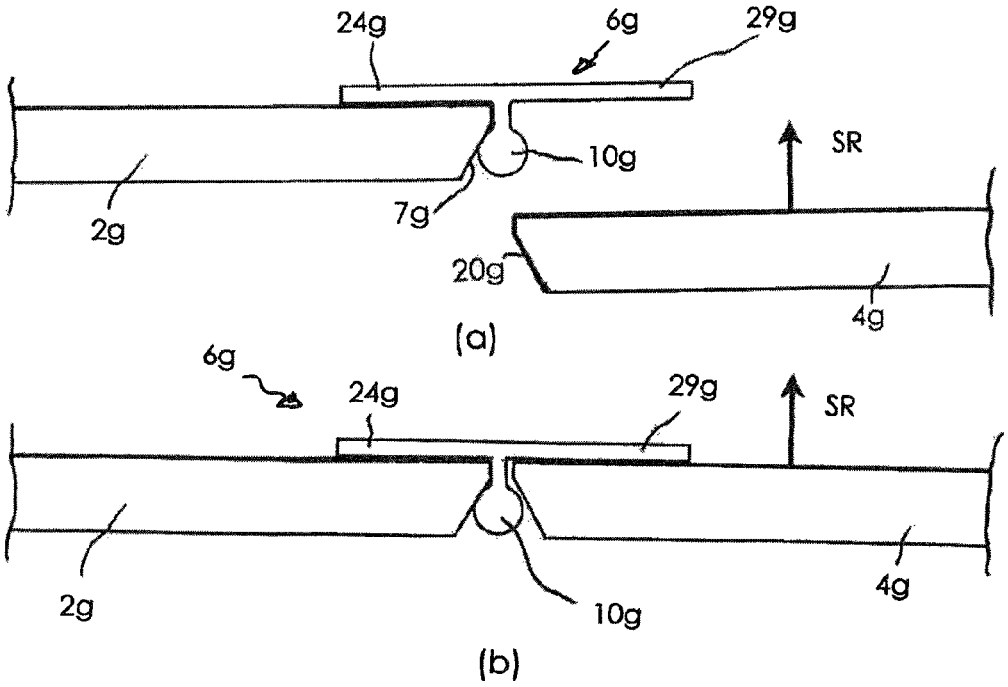
FIG. 8 shows details of a further container according to the invention.

A holding element 6*g* in the illustrative embodiment according to FIG. 8 is arranged on an inner face of a side wall 2*g* and has an abutment element 29*g* which, on the inner face of a container 1*g*, protrudes across a side wall 20*g* of a flap 4*g* directed toward a loading opening of the container 1*g*. In the closed position shown in FIG. 8*b*, the flap 4*g* is held in the closed position by the holding element 6*g*. The abutment element 29*g* bears on the outer face of the flap 4*g* and thus ensures that the flap 4*g* cannot be folded inward into the interior of the container. Advantageously, the abutment element 29*g* also ensures that the flap 4*g* cannot be swiveled into the interior of the container 1*g*.

A container 1*e* shown in FIG. 6 is provided, on each of the side edges 7*e* of a flap 4*e*, with a retainer 6*e*, which is formed by a strip extending across the full length of the side edges 7*e*. The retainer 6*e* comprises a holding body 10*e*, which can be seen in detail in FIGS. 6*c*, 6*d* and 6*e* and which juts out in the closure direction of the flap 4*e* and, at its end, is thickened to form a hook. A holding member 11 for the retainer 6*e* is arranged on a loading-opening edge 20*e* and is formed by a strip that has the same shape as the strip of the retainer 6*e*, and a mating hook for the hook of the holding body 10*e* is thus formed by a thickening at the end of a link element 28 protruding in the opening direction of the flap 4*e*. The strip of the holding member 11 is arranged lying opposite the retainer 6*e* and in the opposite direction, in such a way that the hook and the mating hook protrude in opposite directions and engage in each other in the closed position. Material cuttings 26, 27 are provided in both strips, such that space is available for an elastic bending of the hook and of the mating hook when these are pushed past each other during movement to and from the closed position. In the areas where they are moved relative to each other, the hook and the mating hook are rounded in order to permit a smooth movement of the flap 4*e* to and from the closed position.

While specific embodiments of the invention have been shown and described in detail to illustrate the inventive principles, it will be understood that the invention may be embodied otherwise without departing from such principles.

We claim:

1. A container, comprising: a side wall having a loading opening closable by a flap; and a holding device for holding the flap in a closed position, wherein the holding device comprises a retainer, which is arranged on an edge of the side wall or on an edge of the flap, the retainer having a holding body that protrudes from the edge of the side wall in a direction of the opposing edge of the flap or from the edge of the flap in a direction of the opposing edge of the side, the holding body being provided to hold the flap in the closed position with a counterforce, the holding body being configured so that the flap is movable to the closed position when a counterforce exerted by the holding body is overcome, wherein a) the retainer is non-slidably fixed to the side wall, and the holding body in the closed position, seen in a closing direction of the flap, latches in front of a front-most edge of flap and is arranged on an outer side of the container, or b) the retainer is non-slidably fixed on the flap and holding body in the closed position, seen in the closing direction of the flap, latches behind a rear-most edge of side wall and is arranged on an inner side of the container.

2. The container according to claim 1, wherein the flap is movable from the closed position when the counterforce is overcome.

3. The container according to claim 1, wherein the holding device is provided so as to hold the flap in the closed position by latching the flap on the retainer, by latching the retainer on the side wall, or by latching the retainer on a holding member that is provided to receive the retainer and is arranged on the flap or on the side wall.

4. The container according to claim 1, wherein the retainer is arranged on an edge of the flap directed away from a hinge that connects the flap to the side wall, or on an edge of the side wall directed away from the hinge, or near a respective edge.

5. The container according to claim 1, wherein the container is provided so that the retainer, the flap, the side wall and/or the holding member elastically deform when the counterforce is overcome.

6. The container according to claim 5, wherein the holding body has a convex curvature at least in part.

7. The container according to claim 5, wherein a notch is formed on a edge of the side wall or of the flap, in which notch the holding body engages in the closed position.

8. The container according to claim 5, wherein the holding body engages behind an edge of the flap or of the side wall in the closed position.

9. The container according to claim 5, wherein the holding member has a recess into which the holding body latches in the closed position.

10. The container according to claim 5, wherein the holding body protrudes from the flap in a direction in which the flap is to be closed, or protrudes from the side wall in a direction, in which the flap is to be opened.

11. The container according to claim 5, wherein the holding body and a link element of the holding member have an angled shape.

12. The container according to claim 11, wherein the holding body and link element form a right angle shape.

13. The container according to claim 11, wherein the holding body and link element are hook-shaped.

14. The container according to claim 1, wherein the holding device comprises an abutment element that prevents movement of the flap from the closed position in another possible flap direction.

15. The container according to claim 14, wherein the abutment element prevents movement of the flap from the closed position in the flap direction toward an interior of the container.

16. The container according to claim 14, wherein the abutment element protrudes from the flap via a side edge of the flap lying opposite an edge of the side wall directed toward the loading opening, and/or protrudes from the side wall via an edge of the side wall directed toward the loading opening, lying opposite an edge of the flap.

17. The container according to claim 16, wherein the abutment element protrudes from an outer face of the flap.

18. The container according to claim 16, wherein the abutment element protrudes from an inner face of the side wall.

19. The container according to claim 14, wherein the retainer and the abutment element are together secured on the side wall or on the flap.

20. The container according to claim 19, wherein the retainer and the abutment element are formed as one piece.

* * * * *